United States Patent [19]

Biricz

[11] 4,113,003

[45] Sep. 12, 1978

[54] STARTER BAR HEAD ARRANGEMENT

[75] Inventor: Stefan Biricz, Linz, Austria

[73] Assignee: Vereinigte Österreichische Eisen- und Stahlwerke - Alpine Montan Aktiengesellschaft, Linz, Austria

[21] Appl. No.: 749,119

[22] Filed: Dec. 9, 1976

[30] Foreign Application Priority Data

Dec. 12, 1975 [AT] Austria ..... 9448/75
Jun. 15, 1976 [AT] Austria ..... 4351/76

[51] Int. Cl.[2] ..... B22D 11/08
[52] U.S. Cl. ..... 164/446
[58] Field of Search ..... 164/274, 426, 446, 425, 164/445

[56] References Cited

U.S. PATENT DOCUMENTS

| | | | |
|---|---|---|---|
| 3,080,625 | 3/1963 | Pearson | 164/274 |
| 3,593,777 | 7/1971 | Pietryka | 164/274 |
| 3,643,731 | 2/1972 | Stull | 164/274 |
| 3,921,706 | 11/1975 | Wiesinger | 164/274 |

FOREIGN PATENT DOCUMENTS

| | | | |
|---|---|---|---|
| 725,323 | 3/1955 | United Kingdom | 164/274 SB |

*Primary Examiner*—Francis S. Husar
*Assistant Examiner*—John S. Brown
*Attorney, Agent, or Firm*—Burns, Doane, Swecker & Mathis

[57] ABSTRACT

A starter bar head arrangement to be used in continuous casting plants has at least one strand anchoring piece connecting the starter bar head with the crop end of the strand by casting-on inserted in a recess of the starter bar head so that it protrudes therefrom and fixed by a transverse bolt, the recess being open towards the front face of the starter bar head, and the at least one strand anchoring piece is automatically droppable after removal of the transverse bolt and separation of the crop end.

9 Claims, 12 Drawing Figures

STARTER BAR HEAD ARRANGEMENT

Figure 1:
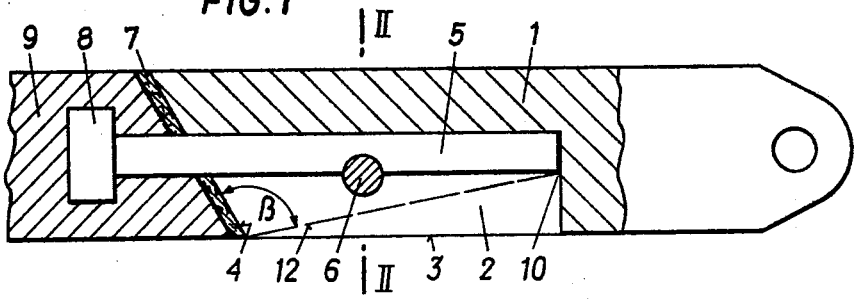

The invention relates to a starter bar head for continuous casting plants, which starter bar head is connectable with the cast strand by at least one strand anchoring piece being cast-on and protruding from the starter bar head at its front side and fixed by means of a transverse bolt, the front face of the starter bar head being covered by an insulating layer.

When the cast strand that is connected with the starter bar has been gripped by the extraction rolls, it is to be separated from the starter bar.

When using tong-shaped or hook-shaped starter bar heads, respectively, the starter bar can be detached from the initial portion of the cast strand by opening the nippers of the tongs or by turning and pivoting the hook-shaped starter bar head, respectively. The initial portion of the cast strand, the so-called crop end, is separated from the cast strand by torch cutting. When detaching the tong-shaped or hook-shaped starter bar head, respectively, from the initial portion of the cast strand, difficulties occur, since frequently these complexly built starter bar head parts weld together with the initial portion of the cast strand, The starter bar head then cannot be used again in most cases. A further disadvantage of these starter bar heads consists in that complex and expensive means are necessary for opening the nippers of the tongs or turning and pivoting the starter bar head, respectively.

With starter bar heads in which the connection with the cast strand is effected by means of strand anchoring pieces inserted in the starter bar head, which strand anchoring pieces weld together with the cast strand, at first the crop end is separated from th cast strand, is removed together with the starter bar, and then the starter bar is brought into deposit position. Thereafter the crop end is separated from the starter bar head by torch cutting. This torch cutting, which is complicated and time-consuming, furthermore comprises the danger of damaging the starter bar head.

The invention aims at preventing these disadvantages and difficulties and has as its object to provide a starter bar head of the above defined kind, which can be detached from the crop end in a simple manner and without the danger of damaging the starter bar head, wherein the starter bar need not be moved.

According to the present invention, these objects are achieved in that the strand anchoring piece is inserted in a recess that is open towards the front face of the starter bar head, wherein after removal of the transverse bolt and separation of the crop end, the strand anchoring piece is automatically droppable.

Suitably, the recess in addition is open towards a side face of the starter bar head.

It is advantageous, if the recess is designed as groove arranged in longitudinal direction of the starter bar head and has outwardly inclined side faces.

For facilitating the sealing of the starter bar head relative to the mould at the onset of casting, it is advantageous, if on the strand anchoring piece there is provided a nose closing the recess relative to the front side.

According to a preferred embodiment, the portion of the strand anchoring piece inserted in the recess has such a cross-section that the distance between the front-side supporting place of the strand anchoring piece on the starter bar head, and its limiting face lying opposite that supporting place, is maximally equal to the shortest distance between the supporting place and the wall of the recess opposite that supporting place.

Thus it is possible to make the front side of the starter bar head closed around the strand anchoring piece, so that a warping of the starter bar head caused by a one-sided heat influence is reliably prevented.

Advantageously, the limiting face of the strand anchoring piece is designed as circular cylinder face, whereby the strand anchoring piece is especially easy to make.

In order to facilitate dropping of the crop end, it is advantageous, if the front face is inclined towards the side face of the starter bar head.

Figure 2:
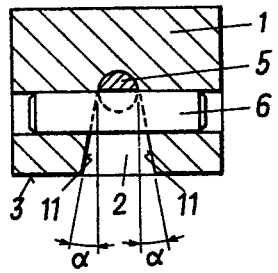
Figure 3:
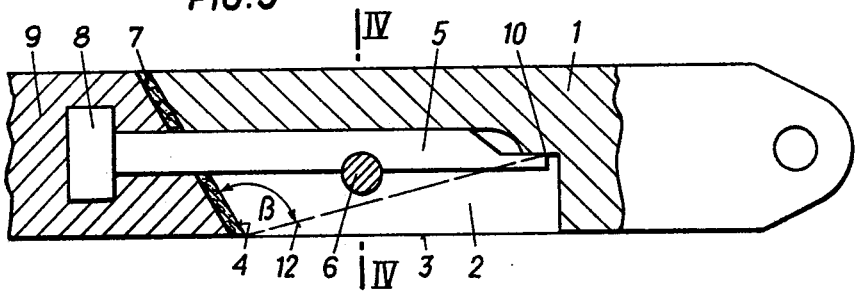
Figure 4:
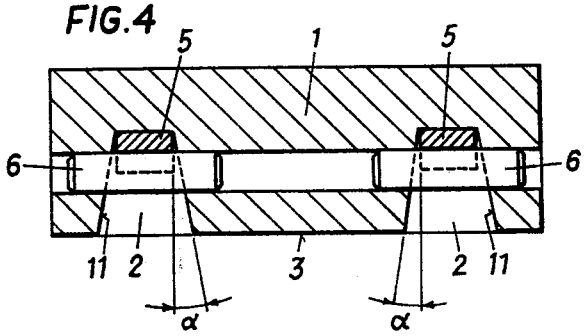
Figure 1A:
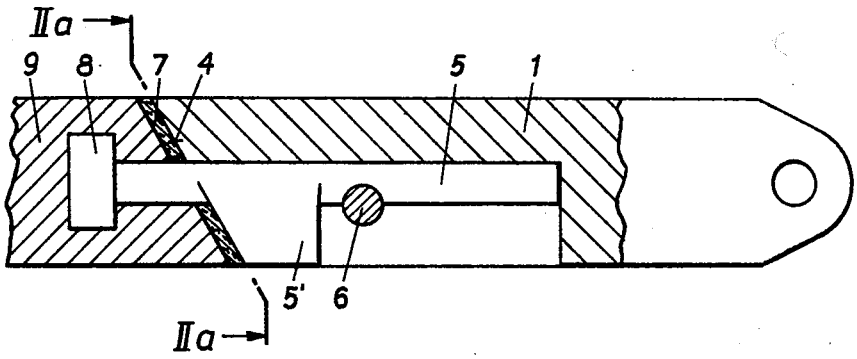
Figure 2A:
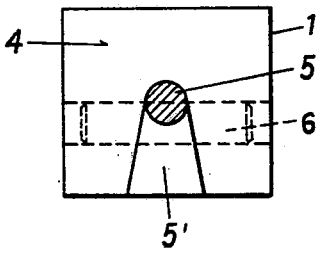
Figure 5:
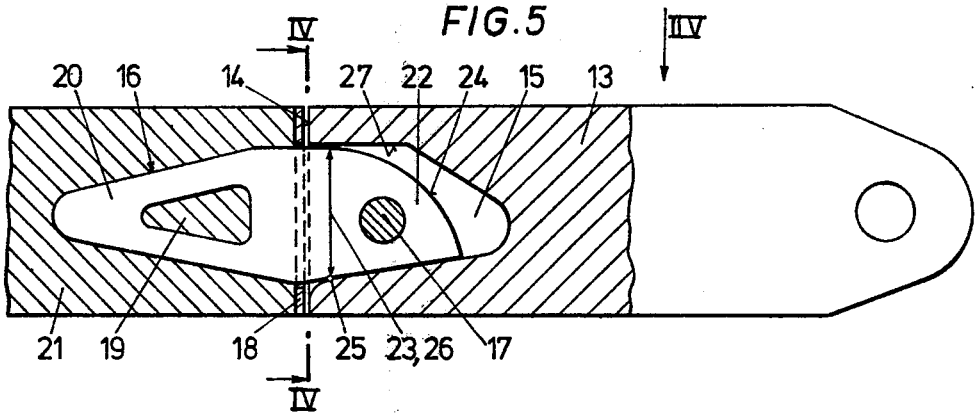
Figure 6:
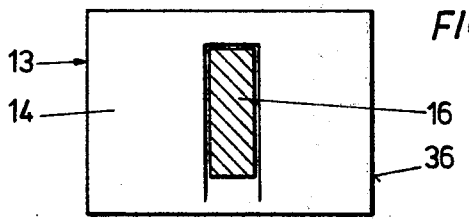
Figure 7:
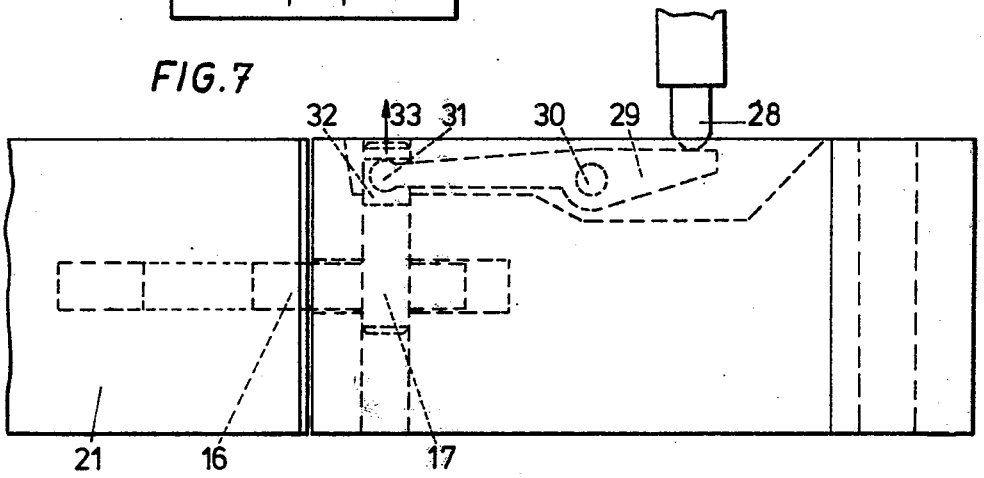
Figure 8:
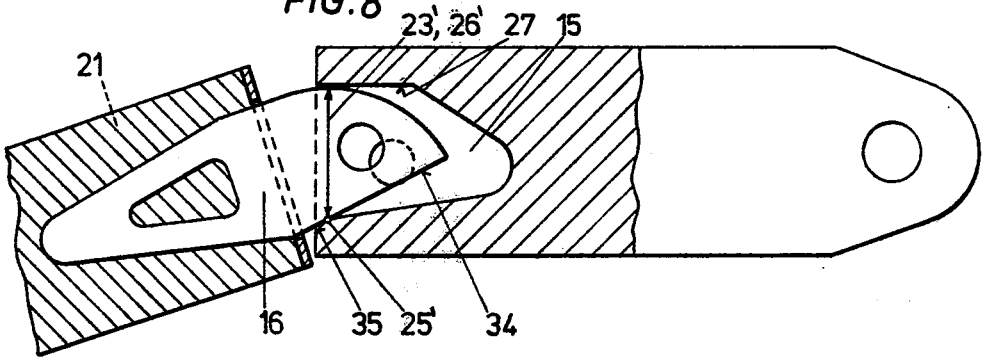
Figure 9:
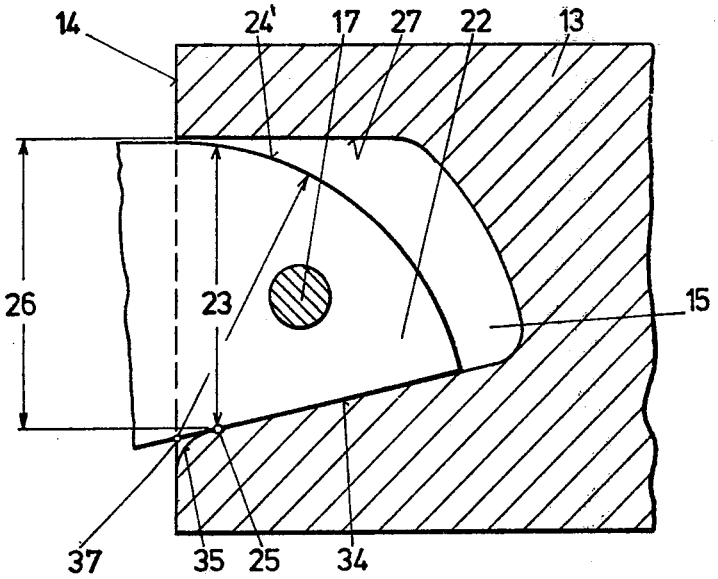
Figure 10:
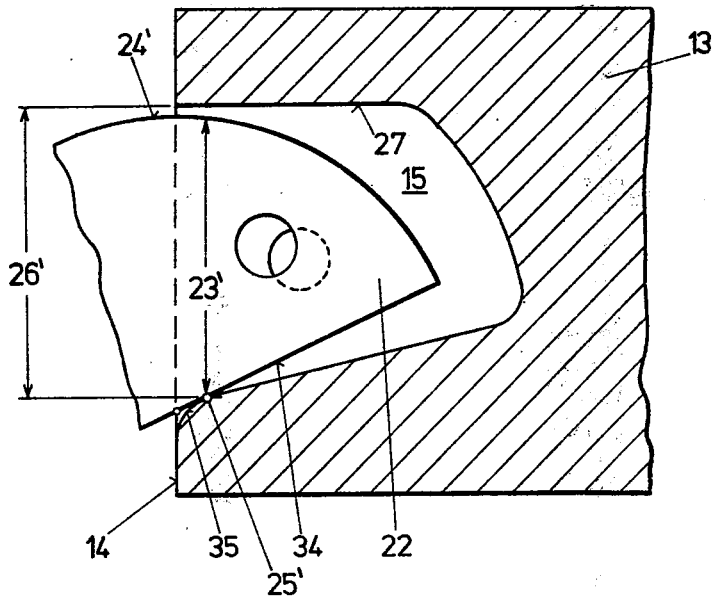

The invention shall now be explained in more detail by way of a number of examples and with reference to the accompanying drawings, wherein:

FIG. 1 shows a starter bar head with cast-on cast strand, to be used in continuous casting plants for billets, in longitudinal section, FIG. 2 is a section along line II—II of FIG. 1, FIG. 1*a* shows a modified embodiment in a manner analogous to FIG. 1, FIG. 2*a* shows a section along line II*a*—II*a* of FIG. 1*a*, FIGS. 3 and 4 show an embodiment of a starter bar head to be used in continuous casting plants for slabs in illustrations analogous to FIGS. 1 and 2, FIG. 5 shows a further embodiment, also to be used in continuous casting plants for billets, in a manner analogous to FIG. 1, FIG. 6 is a section along line VI—VI of FIG. 5, FIG. 7 is a view in the direction of the arrow VII of FIG. 5, FIG. 8 illustrates the automatic dropping of the crop end, and FIGS. 9 and 10 show a different embodiment in the same manner as FIGS. 5 and 8.

In FIGS. 1 to 4, a starter bar head is denoted by 1, which is articulately connected in a usual manner, not illustrated in detail, with the starter bar. The starter bar head is provided with a groove 2 arranged in longitudinal direction of the head, which groove is open towards a side face 3 of the head and extends into the front face 4 of the starter bar head. In this groove 2, a strand anchoring piece 5 designed as bolt is inserted. A transverse bolt 6 penetrates the starter bar head 1 and the strand anchoring piece 5, whereby the latter is fixed in the starter bar head. An asbestos plate 7 prevents molten steel from entering the groove 2 and a welding together of the cast strand with the starter bar head during the casting-on, i.e., when the cast-strand-side end 8 of the strand anchoring piece 5 is cast around, which is disc-shaped. The disc-shaped end 8 safeguards a transmission of extraction forces onto the cast strand at the onset of casting. The cast-on initial portion of the cast strand, the crop end, is denoted by 9; it is separated from the cast strand by torch cutting.

For detaching the crop end 9, the transverse bolt 6 is laterally pushed out, whereupon the crop end, due to its own weight, tilts around point 10 and drops. It is evident that the separation of the crop end 9 from the starter bar head 1 does not require any movement of the starter bar or its head, respectively, i.e., it can rest on its place of deposit.

The side faces 11 of the groove 4 are outwardly inclined by an angle $\alpha$, in order to avoid any jamming of the strand anchoring piece 5 when the crop end is being detached. The front face 4 of the starter bar head is inclined by an angle $\beta$ of at least 90° relative to an imaginary connecting plane 12 — entered in broken lines — constituted by the tilting point 10 and the edge formed by the lower side face 3 and the front face 4. Thereby a faultless release of the crop end 9 from the front face 4 of the starter bar head is safeguarded.

In the embodiment according to FIGS. 1*a* and 2*a*, the strand anchoring piece 5 is provided with a nose 5', which closes the recess 2 toward the front side 4, so that the insulating layer 7 is better held and sealing of the front face 4 toward the mould at the onset of casting is facilitated.

FIGS. 3 and 4 show an embodiment of the starter bar head for the continuous casting of slabs. Because of the great width of the slab, two adjacently arranged strand anchoring pieces 5 are provided, each of which being inserted in a separate groove 4. Instead of the discs 8 arranged at the ends of the two strand anchoring pieces, also a single disc connecting the strand anchoring pieces can be provided, whereby the two strand anchoring pieces 5 are combined to form a unit.

FIGS. 5 to 10 show two further embodiments of a starter bar head according to the invention, which is denoted by 13. The starter bar head is provided with a recess 15 open only toward the front face 14, in which recess the strand anchoring piece 16 is inserted. A transverse bolt 17 penetrates the starter bar head 13 and the strand anchoring piece 16, whereby the latter is fixed in the starter bar head 13. An asbestos plate 18 prevents the cast strand from welding-together with the starter bar head 13 during the casting-on. Through the opening 19 of the cast-strand-side end 20 of the strand anchoring piece, a transmission of the extraction forces onto the cast strand at the onset of casting is safeguarded. The cast-on initial portion of the cast strand is denoted by 21.

The portion 22 of the strand anchoring piece 16 inserted in the starter bar head has such a cross-section in its longitudinal plane that the distance 23 between the forwardmost support place 25 of the face 34 of the strand anchoring piece on the starter bar head and its limiting face 24 opposite this support place 25 is equal to the shortest distance 26 between the support place 25 and the wall 27 of the recess 15 opposite that support place 25.

For detaching the crop end 21, the transverse bolt 17 is laterally removed from the strand anchoring piece 16. This can be done by simply pushing it out, or, as shown in FIG. 7, by a hydraulically displaceable bolt 28, which pivots lever 29 around its axis 30, whereby the end 31 of the lever 29, which end protrudes into a recess 32 of the transverse bolt 17, is displaced in the direction of the arrow 33. When the transverse bolt 17 has been detached, the crop end 21, due to its own weight, tilts off with the face 34 of the strand anchoring piece around the front-side rounded-off area 35 of the recess. This is illustrated in FIG. 8. The support place 25 moves to a place denoted by 25' during the tilting-off, whereby the distance 26 increases to a distance 26'. Distance 23' is chosen to be correspondingly greater than distance 23, so that the distance between the front-side place of support of the strand anchoring piece and its limiting face opposite that place also during the tilting-off is equal to the respective shortest distance between this place of support and the wall opposite thereof. If the rounded-off area 35 is a circular cylinder, the limiting face 24 is an involute face. As soon as the friction forces prevailing are overcome by the weight of the crop end, the strand anchoring piece 16 slides out of the recess 15 and drops. Also in these embodiments of the starter bar head, the crop end is separated from the starter bar head without requiring a movement of the starter bar or its head, respectively. As can be seen from FIG. 6, the outer rim 36 of the front face 14 of the starter bar head is not interrupted, which results in a very easy sealing relative to the mould at the onset of casting, by insertion of asbestos strings, etc. The front face 14 of the starter bar head 13 dissipating the heat of the initial portion of the cast strand is a closed annular face, whereby thermal stresses cannot cause a one-sided warping of the starter bar head 13.

In continuous casting plants for slabs, it may be necessary for the transmission to the cast strand of the high extraction forces occurring to provide two or more strand anchoring pieces 16. In this case they are parallel to one another and approximately evenly distributed over the width of the starter bar head.

FIGS. 9 and 10 show an embodiment, in which the limiting face 24' of the strand anchoring piece is designed as circular cylinder face, whose horizontal axis 37, as can be seen from FIG. 9, extends where the front face 14 and the lower limiting face 34 intersect.

In this embodiment, the distances 23'' and 23''' (FIG. 10), respectively, are smaller than the distances 26 and 26' (FIG. 10), respectively, so that tilting-off occurs especially easily.

The limiting face of the strand anchoring piece could also have other simple geometric shapes and thus could be made by correspondingly easy means, insofar as — as can be seen from FIG. 10 — the distance 23''' is smaller than the distance 26' in any position during tilting-off of the strand anchoring piece.

I claim:

1. In a starter bar head arrangement to be used in continuous casting plants for strands with at least one strand anchoring piece protruding from the starter bar head at the front side thereof, a transverse bolt being provided for fixing the at least one strand anchoring piece, the starter bar head being connectable with the cast strand having a crop end by casting-on said at least one strand anchoring piece, an insulating layer being provided to cover the front face of the starter bar head, the improvement which comprises a recess provided in the starter bar head open towards the front face of the starter bar head, the at least one strand anchoring piece being inserted therein, and the at least one strand anchoring piece being automatically droppable after the removal of the transverse bolt and separation of the crop end, a certain portion of the at least one strand anchoring piece being inserted in said recess, said portion having such a cross-section that the distance between a forwardmost supporting place of the at least one strand anchoring piece on the starter bar head and an oppositely arranged limiting face of the at least one strand anchoring piece is, at most, equal to the shortest distance between a supporting place in the recess and an oppositely arranged wall of said recess.

2. A starter bar head arrangement as set forth in claim 1, wherein the at least one strand anchoring piece includes a limiting face configured as circular cylinder face.

3. A starter bar head to be used in continuous casting plants for moving a cast strand to a generally horizontal position, said strand including a crop end to which said starter bar is to be connected, said starter bar head comprising:

a starter bar head body portion, said body portion including a forwardly open recess;

a strand anchoring piece projecting forwardly from a front end of said recess and being castable to said crop end of said strand;

a transverse pin for coupling said strand anchoring piece to said body portion; and an insulating layer covering a front face of said body portion adjoining said crop end of said strand;

said recess being open toward a lower side face of said body portion such that in response to removal of said transverse pin said anchoring piece, due to the weight of said crop end, automatically drops downwardly from said body portion independently of movement of said body portion.

4. A starter bar head arrangement as set forth in claim 3, wherein the at least one strand anchoring piece is provided with a nose closing the recess toward the front face thereof.

5. A starter bar head to be used in continuous casting plants for moving a cast strand to a generally horizontal position, said strand including a crop end to which said starter bar is to be connected, said starter bar head comprising:

a starter bar head body portion, said body portion including a forwardly open recess;

a strand anchoring piece projecting forwardly from a front end of said recess and being castable to said crop end of said strand;

a transverse pin for coupling said strand anchoring piece to said body portion; and an insulating layer covering a front face of said body portion adjoining said crop end of said strand;

said recess comprising a groove arranged in the longitudinal direction of said body portion and having downwardly and outwardly inclined side faces such that in response to removal of said transverse pin said anchoring piece, due to the weight of said crop end, automatically drops downwardly from said body portion independently of movement of said body portion.

6. A starter bar head arrangement as set forth in claim 5, wherein the at least one strand anchoring piece is provided with a nose closing the recess toward the front face thereof.

7. A starter bar head to be used in continuous casting plants for moving a cast strand to a generally horizontal position, said strand including a crop end to which said starter bar is to be connected, said starter bar head comprising:

a starter bar head body portion, said body portion including a forwardly open recess;

a strand anchoring piece projecting forwardly from a front end of said recess and being castable to said crop end of said strand;

a transverse pin for coupling said strand anchoring piece to said body portion; and an insulating layer covering a front face of said body portion adjoining said crop end of said strand;

a certain portion of said anchoring piece being inserted in said recess, said portion having such a cross-section that the distance between a forwardmost supporting place of said anchoring piece on body portion and an oppositely arranged limiting face of said anchoring piece is, at most, equal to the shortest distance between the supporting place in the recess and an oppositely arranged wall of said recess such that in response to removal of said transverse pin said anchoring piece, due to the weight of said crop end, automatically drops downwardly from said body portion independently of movement of said body portion.

8. A starter bar head arrangement as set forth in claim 7, wherein the at least one strand anchoring piece has a limiting face designed as circular cylinder face.

9. A starter bar head to be used in continuous casting plants for moving a cast strand to a generally horizontal position, said strand including a crop end to which said starter bar is to be connected, said starter bar head comprising:

a starter bar head body portion, said body portion including a forwardly open recess;

a strand anchoring piece projecting forwardly from a front end of said recess and being castable to said crop end of said strand;

a transverse pin for coupling said strand anchoring piece to said body portion; and an insulating layer covering a front face of said body portion adjoining said crop end of said strand;

said front face being inclined toward the lower side face of the body portion, and said recess being configured in relation to said anchoring piece such that in response to removal of said transverse pin said anchoring piece, due to the weight of said crop end, automatically drops downwardly from said body portion independently of movement of said body portion.

* * * * *